US006954515B2

(12) United States Patent
Bjorkholm et al.

(10) Patent No.: US 6,954,515 B2
(45) Date of Patent: Oct. 11, 2005

(54) RADIATION SOURCES AND RADIATION SCANNING SYSTEMS WITH IMPROVED UNIFORMITY OF RADIATION INTENSITY

(75) Inventors: Paul Bjorkholm, Newport Beach, CA (US); James E. Clayton, Henderson, NV (US)

(73) Assignee: Varian Medical Systems, Inc.,, Palo Alto, CA (US)

( * ) Notice: Subject to any disclaimer, the term of this patent is extended or adjusted under 35 U.S.C. 154(b) by 0 days.

(21) Appl. No.: 10/423,770

(22) Filed: Apr. 25, 2003

(65) Prior Publication Data

US 2004/0213375 A1 Oct. 28, 2004

(51) Int. Cl.[7] ..... H01J 35/30

(52) U.S. Cl. ..... 378/137; 378/57; 378/98.6; 378/113

(58) Field of Search ..... 378/57, 65, 98.6, 378/137, 113; 250/396 ML; 335/210, 296, 297

(56) References Cited

U.S. PATENT DOCUMENTS

| | | | | |
|---|---|---|---|---|
| 4,303,860 A | | 12/1981 | Bjorkholm et al. | |
| 4,342,914 A | | 8/1982 | Bjorkholm | |
| 4,382,208 A | | 5/1983 | Meddaugh et al. | |
| 4,400,650 A | | 8/1983 | Giebeler, Jr. | |
| 4,768,214 A | | 8/1988 | Bjorkholm | |
| 4,799,247 A | | 1/1989 | Annis et al. | |
| 4,819,256 A | | 4/1989 | Annis et al. | |
| 4,839,913 A | | 6/1989 | Annis et al. | |
| 5,124,658 A | * | 6/1992 | Adler | 315/500 |
| 5,159,240 A | | 10/1992 | Chen et al. | |
| 5,159,617 A | * | 10/1992 | King et al. | 378/57 |
| 5,251,240 A | * | 10/1993 | Grodzins | 376/157 |
| 5,313,511 A | | 5/1994 | Annis et al. | |
| 5,422,926 A | | 6/1995 | Smith et al. | |
| 5,442,672 A | | 8/1995 | Bjorkholm et al. | |
| 5,849,252 A | * | 12/1998 | Wakamoto et al. | 422/186.04 |
| 5,917,880 A | | 6/1999 | Bjorkholm | |
| 6,009,146 A | * | 12/1999 | Adler et al. | 378/98.6 |
| 6,069,936 A | | 5/2000 | Bjorkholm | |
| 6,301,326 B2 | | 10/2001 | Bjorkholm | |
| 6,366,021 B1 | | 4/2002 | Meddaugh et al. | |
| 6,486,482 B1 | | 11/2002 | Anderberg et al. | |
| 6,542,574 B2 | * | 4/2003 | Grodzins | 378/57 |
| 6,628,745 B1 | * | 9/2003 | Annis et al. | 378/21 |

OTHER PUBLICATIONS

McDonald Marci, Checkpoint Terror, U.S. News & World Report, Feb. 11, 2002, p. 52, USA.

* cited by examiner

*Primary Examiner*—Craig E. Church
*Assistant Examiner*—Jurie Yun
(74) *Attorney, Agent, or Firm*—Brandon N. Sklar; Kaye Scholer LLP

(57) ABSTRACT

A radiation source is disclosed comprising a source of charged particles that travel along a path. Target material lies along the path to generate radiation upon impact by the beam. A magnet is provided to deflect the beam prior to impacting the target. The magnet may generate a time-varying magnetic field or a constant magnetic field. A constant magnetic field may be varied spatially across the beam. The magnet may be an electromagnet or a permanent magnet. In one example, deflection of the beam results in impact of the beam on the target along a plurality of axes. In another example, portions of the beam are differentially deflected. The source may thereby irradiate an object to be scanned with more uniform radiation. The charged particles may be electrons or protons and the radiation may be X-ray or gamma ray radiation, or neutrons. Scanning systems incorporating such sources, methods of generating radiation and methods of examining objects are disclosed, as well.

68 Claims, 14 Drawing Sheets

RADIATION SOURCES AND RADIATION SCANNING SYSTEMS WITH IMPROVED UNIFORMITY OF RADIATION INTENSITY

FIELD OF THE INVENTION

Radiation sources and radiation scanning systems for examining the contents of an object.

BACKGROUND OF THE INVENTION

Radiation is commonly used in the non-invasive inspection of objects such as luggage, bags, briefcases, and the like, to identify hidden contraband at airports and public buildings. The contraband may include hidden guns, knives, explosive devices and illegal drugs, for example. As criminals and terrorists have become more creative in the way they conceal contraband, the need for more effective non-invasive inspection techniques has grown. While the smuggling of contraband onto planes in carry-on bags and in luggage has been a well-known, on-going concern, a less publicized but also serious threat is the smuggling of contraband across borders and by boat in large cargo containers. Only 2%–10% of the 17 million cargo containers brought to the United States by boat are inspected. "Checkpoint Terror", U.S. News and World Report, Feb. 11, 2002, p. 52.

FIG. 1 is a schematic diagram of a radiation scanning system 10 including a radiation source 12 scanning an object 14 with a vertically diverging fan beam 16 of radiation. A detector 18 is behind the object 14, to detect radiation transmitted through the object. The object is moved horizontally (out of the page) through the vertically extending fan beam 16 by a conveying system (not shown). Radiation transmitted through the object 14 is attenuated to varying degrees by the object and its contents. The attenuation of the radiation is a function of the density and atomic composition of the materials through which the radiation passes. The attenuated radiation is detected and radiographic images of the contents of the object 14 are generated for inspection. The images show the shape, size and varying densities of the contents.

To examine larger objects (greater than about 5 feet, 1.5 meters thick, for example), the radiation source 10 may be a linear accelerator including a source of electrons 20 and a target 22 of material having a high atomic number, such as tungsten. An electron beam 24 is shown being emitted along an axis R through the electron source 20 and the target 22, referred to as a central ray. The electron beam 24 impacts the target 22, causing generation of a beam of X-ray radiation. Linear accelerators are described in more detail in U.S. Pat. No. 6,366,021 B1, U.S. Pat. No. 4,400,650 and U.S. Pat. No. 4,382,208, which are assigned to the assignee of the present invention and are incorporated by reference, herein.

The radiation beam is collimated into the fan beam 16 by a collimator (not shown) at a distal end of the source 12. The fan beam 16 is emitted over an arc of about 30°. The fan beam illuminates a front face 14*a* of the object 14. The system 10 may be referred to a line scanner.

The intensity of the X-ray beam at point A on the face of the object 14, aligned with the central ray, is at a maximum M. The intensity of the X-ray beam 18 decreases as the angle from the central ray R increases. At best, the intensity is substantially uniform over only a few degrees around the central ray. For example, for a 9 MeV (peak intensity) X-ray beam 18, the intensity of the beam at an angle of about +/−12°, indicated as points B and C on the face 11*a* of the cargo conveyance 18, is about 50% of the intensity at point A, along the central ray. Better radiation scanning systems for scanning objects can compensate for intensity drops of up to about 50%. As intensity drops beyond about 50% at higher angles from the central ray R, however, the object penetration and contrast sensitivity may become significantly reduced. The intensity of the radiation beam also decreases as the distance between the source 10 and the object 14 increases, as a function of the square of the distance.

Standard cargo containers are typically 20–50 feet long (6.1–15.2 meters), 8 feet high (2.4 meters) and 6–9 feet wide (1.8–2.7 meters). Air cargo containers, which are used to contain a plurality of pieces of luggage or other cargo to be stored in the body of an airplane, may range in size (length, height, width) from about 35×21×21 inches (0.89×0.53×0.53 meters) up to about 240×118×96 inches (6.1×3.0×2.4 meters). Sea cargo containers are typically about 40 feet long, 8 feet wide and 8 feet high. Large collections of objects, such as many pieces of luggage, may also be supported on a pallet. Pallets, which may have supporting side wall, may be of comparable sizes as cargo containers. The term "cargo conveyance" is used herein to encompass cargo containers, sea containers and pallets.

To illuminate large cargo conveyances with a more uniform portion of an X-ray beam (within about 50% of maximum), the source must be very far from the cargo conveyance. For example, to illuminate a cargo container with a height of about 8 feet (2.4 meters) with a vertical radiation beam emitted over an angle of about 24 degrees (+/−12 degrees from the central ray), the source needs to be about 19 feet (about 5.8 meters) from the face of the cargo container. If the beam could be emitted over an angle of about 120 degrees (+/−60) degrees from the central ray), in contrast, the source may be about 2.5 feet (about 0.8 meters) from the face of the cargo container. More compact radiation scanning systems, where the radiation source is closer to the object than in current systems, would be advantageous. They would occupy less space, as well as suffer from less drop in radiation intensity due to the distance between the source and the object.

SUMMARY OF THE INVENTION

In accordance with embodiments of the invention, the intensity distribution of a radiation beam on a face of an object under inspection is improved by deflecting a beam of charged particles, such as electrons, along a plurality of central rays to cause impact on a target material to generate radiation beams along the plurality of central rays. The greater the number of beams along respective central rays, the more uniform the radiation intensity on the face of the object. Embodiments are disclosed that effectively deflect the beam of charged particles along a large number of central rays, which may result more uniform radiation intensity on the face of the object.

In accordance with an embodiment of the invention, a radiation source is disclosed comprising a housing and a first, accelerating chamber within the housing to accelerate a beam of charged particles an output of the chamber. A second chamber within the housing has an input aligned with the output of the first chamber to receive the beam of accelerated charged particles. Target material is supported within the second chamber. Impact of the target material by the accelerated charged particles causes generation of radiation. A magnet is supported by the housing proximate the second chamber, to provide a magnetic field to deflect the beam of accelerated charged particles prior to impacting the target material. The resulting radiation will have a maximum intensity along a central ray of the deflected beam. By deflecting the beam one or more times and/or not deflecting the beam, a plurality of radiation beams may be generated, each having maximum intensities along different central rays, improving the uniformity of radiation intensity about an angular range.

The magnet may generate a time-varying field, and may be an electromagnet. The electromagnet may be cycled between generating a magnetic field in a first direction, generating a magnetic field in a second direction, which may be opposite the first direction, and being off, for example. The beam of charged particles is then deflected along a first axis, deflected along a second axis and passes undeflected, respectively, to impact the target along the first axis, the second axis and a third, undeflected axis, respectively. Radiation resulting from the impact on the target along each axis has a peak intensity along each axis. An object being irradiated by the resulting radiation will thereby be exposed to a more uniform intensity of radiation.

Alternatively, the magnet may provide a constant magnetic field. The magnet may be configured to generate a magnetic field that varies spatially across a width of the beam of charged particles. The beam is deflected differentially across the width. The beam may be converged or diverged, for example. To expose the beam to the spatially varying magnetic field, the magnet may have irregularly shaped pole portions. The pole portions may be triangular and/or may be separated by a varying distance, for example. The magnet may be a permanent magnet or an electromagnet. The radiation resulting from the impact of the deflected beam may have a substantially uniform intensity about an angular range. As used herein, the term "substantially uniform intensity" means that the intensity is uniform within the tolerances of the radiation source, including the magnet.

The beam of charged particles may be a beam of electrons, for example. The target may be a refractory metal, such as tungsten, for example. The radiation resulting from the impact of the target by the beam may be X-ray radiation, for example.

In accordance with another embodiment of the invention, a linear accelerator is disclosed comprising a housing. An accelerating chamber with an output is provided within the housing. The chamber has a first longitudinal axis aligned with the output. A source of electrons is supported by the housing to emit electrons along the first longitudinal axis. A tube comprises a passage having a second longitudinal axis, has a first end with an input coupled to the output of the chamber such that the second longitudinal axis is aligned with the first longitudinal axis. Target material is supported within the tube. A magnet is supported by the housing. The magnet has opposing poles partially surrounding the tube, to provide a magnetic field to deflect the electron beam prior to impacting the target.

In accordance another embodiment of the invention, a radiation source is disclosed comprising a housing and a source of charged particles supported by the housing. Target material is supported by the housing along a path of the charged particles. Impact of the charged particles with the target causes generation of radiation. A magnet is supported by the housing between the source and the target.

In accordance with another embodiment of the invention, a system for examining an object is disclosed comprising a conveyor system to move the object through the system and a source of radiation. The radiation source comprises a housing and a source of a beam of charged particles supported by the housing. The source of charged particles has an output to provide the beam along a path. A target material is supported by the housing along the path. The target material generates radiation upon impact of the beam with the target. A magnet is supported by the housing and partially surrounds the longitudinal path, to provide a magnetic field to deflect the beam prior to impacting the target. The radiation source is positioned with respect to the conveying system such that radiation emitted by the source irradiates an object for inspection on the conveying system. A detector is positioned to receive radiation interacting with the object. The object may be irradiated with substantially uniform intensity. As mentioned above, the term "substantially uniform intensity" as used herein means that the intensity is uniform within the tolerances of the radiation source, including the magnet.

The radiation source may be on a first side of the conveying system and a detector may be on a second side of the conveying system, to detect radiation transmitted through the object. The radiation source may be configured as described above, for example. The radiation source may have a first, longitudinal axis and the radiation beam may have a central ray along a second axis transverse to the first axis, to irradiate an object that is not aligned with the longitudinal axis of the radiation source.

In accordance with another embodiment of the invention, a method of generating radiation is disclosed comprising directing a beam of charged particles towards a target, deflecting the beam and impacting the target by the deflected beam. The beam may be deflected by providing a magnetic field, which may be a time-varying magnetic field or a constant magnetic field. The constant magnetic field may vary spatially across a width of the beam of charged particles, to differentially deflect the beam.

In accordance with another embodiment of the invention, a method of examining contents of an object with a radiation source is disclosed comprising directing a beam of charged particles along a longitudinal path, towards a target, deflecting the beam and impacting the target by the deflected beam to generate radiation. The method further comprises irradiating the object with the radiation and detecting radiation interacting with the object.

DESCRIPTION OF THE PREFERRED EMBODIMENTS

Figure 2:
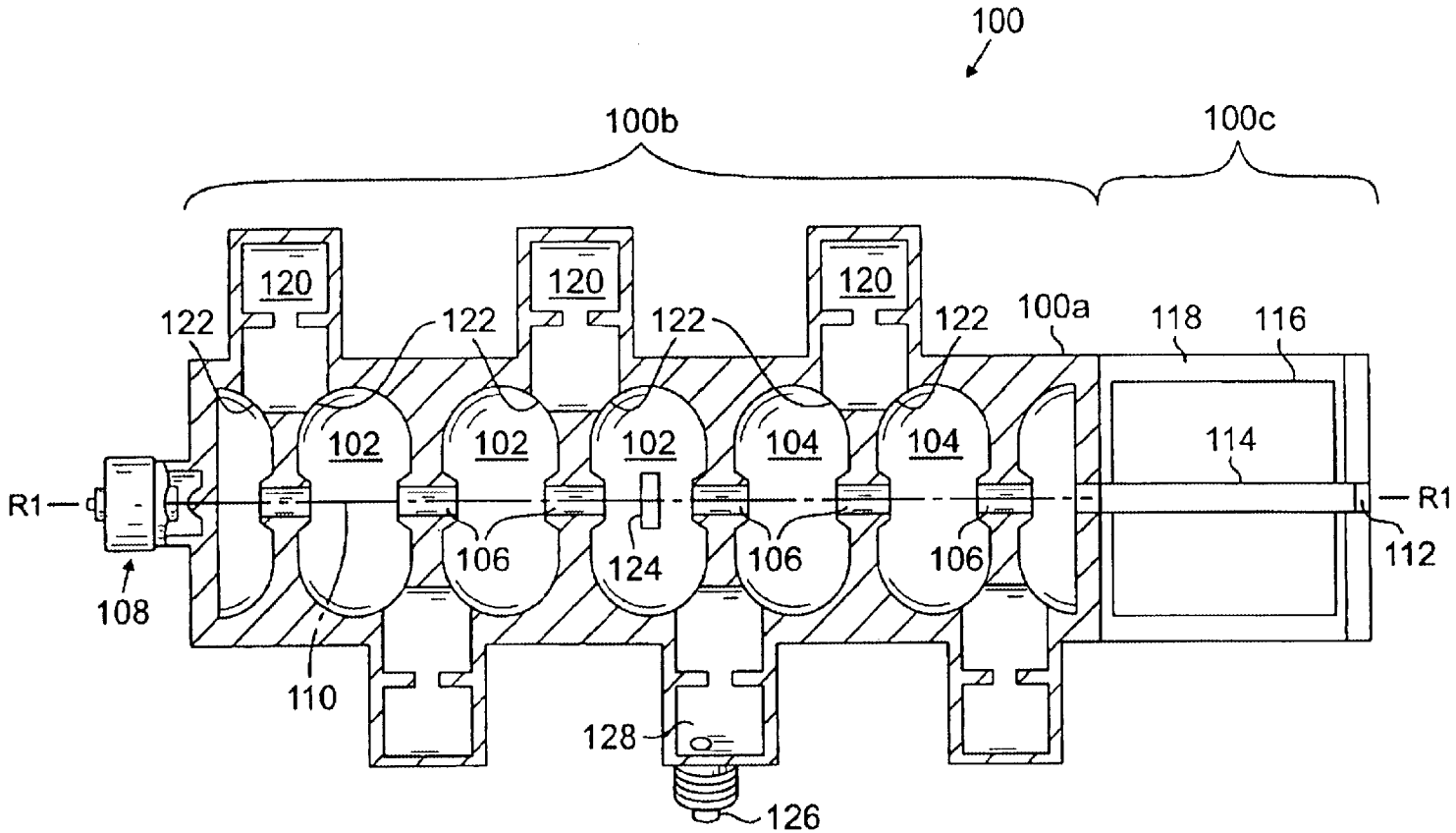
FIG. 2 is a schematic axial sectional view of an example of a radiation source, such as a linear accelerator, in accordance with an embodiment of the invention.

FIG. 2 is a schematic axial sectional view of an example of a radiation source 100, in accordance with an embodiment of the invention, wherein a beam of charged particles is accelerated and directed towards a target to generate radiation. The charged particles may be electrons or protons. The resulting radiation may be X-ray radiation, gamma ray radiation, or neutrons, for example.

In one example, the source 100 is an accelerator, such as a linear accelerator, generating X-ray radiation. The linear accelerator 100 may be a charged particle standing wave accelerator, for example. The linear accelerator 100 comprises a housing 100*a* with a body portion 100*b* and a distal portion 100*c*. The body portion 100*a* includes a chain of electromagnetically coupled, doughnut shaped resonant cavities 102, 104, with aligned central beam apertures 106. An electron gun 108 at one end of the chain of cavities emits an electron beam 110 through the apertures 106. The source 100 may be a betatron or a cyclotron, as well.

In the distal portion 100*b*, a first end of a drift tube 114 is connected to a second end of the chain of cavities. A target 112 of tungsten, for example, is provided at a second end of the drift tube 114. The target 112 may be disc shaped or may be elliptical, as discussed further below. The target material may be other materials with a high atomic number and a high melting points, such as other refractory metals. A magnet 116 is provided around the drift tube 114. Shielding material 118, of tungsten, for example surrounds the magnet 116 and drift tube 114. The cavities 102, 104 are electromagnetically coupled together through a "side" or "coupling" cavity 120 that is coupled to each of the adjacent pair of cavities by an iris 122. The cavities are under vacuum. Microwave power enters one of the cavities along the chain, through an iris 124, to accelerate the electron beam 110. The linear accelerator body 100*a* is excited by microwave power at a frequency near its resonant frequency, between about 1000 to about 10,000 MHz, for example. After being accelerated, the electron beam 110 strikes the target 112, causing the emission of X-ray radiation.

Movable plungers or probes 126 may extend radially into one of the coupling cavities 128 to vary the energy of the accelerating electrons, to generate radiation beams at multiple energies. One probe 122 is shown in FIG. 2. A corresponding probe is provided in the cavity 124 behind the probe 122 and cannot be seen in this view. The probes 122 are moved under the control of a computer program to alter the magnetic fields within the cavity. The energy of the radiation generated by the electrons as the electron beam 110 impacts the target is thereby varied. Such a linear accelerator 100 is described in more detail in U.S. Pat. No. 6,366,021 B1, which is assigned to the assignee of the present invention and is incorporated by reference, herein. Linear accelerators are also described in U.S. Pat. No. 4,400,650 and U.S. Pat. No. 4,382,208, which are also assigned to the assignee of the present invention and are incorporated by reference, herein.

In accordance with an embodiment of the invention, the magnet 116, which may emit a time varying magnetic field or a constant magnetic field, selectively deflects the electron beam 110 so that it impacts the target 112 at one or more locations displaced from the central axis of the initial beam 58, changing the central rays of the resulting radiation beam, as discussed further below. The magnet 116 may be an electromagnet, generating a time-varying or constant magnetic field, a permanent magnet generating a constant magnetic field, or a combination of the two.

Figure 3:
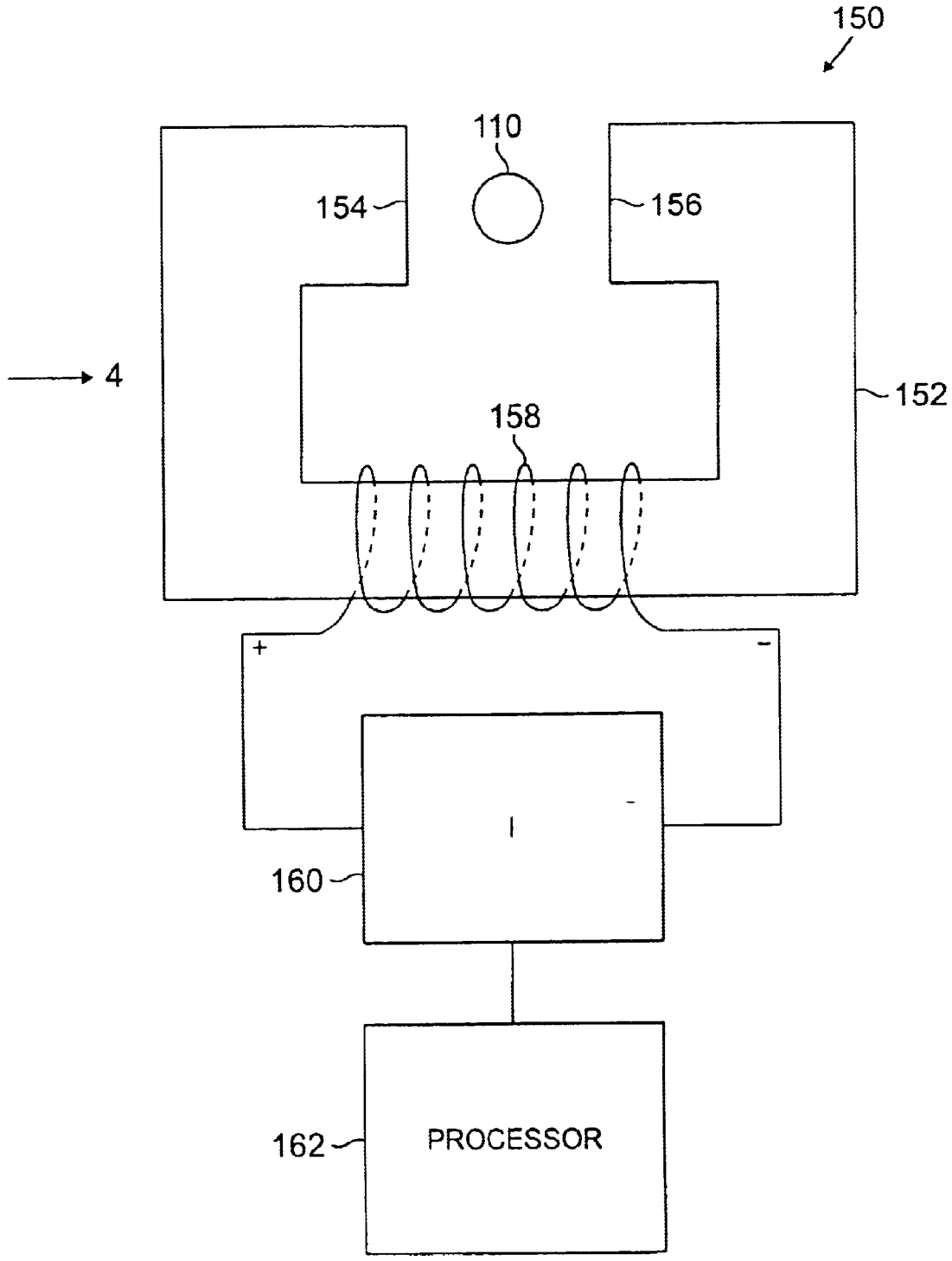
FIG. 3 is a front view of a schematic representation of an electromagnet that may be provided in the distal portion of the linear accelerator of FIG. 2.

FIG. 3 is a front view of a schematic representation of an electromagnet 150 that may be provided in the distal portion 100*b* of the linear accelerator 100. The electromagnet may comprise a horseshoe-shaped core of 152 of ferromagnetic or paramagnetic material. Iron, nickel or aluminum-nickel-cobalt alloys, such as Alnico may be used, for example. The core 152 defines opposing pole faces 154, 156. A coil 158 is wound around the core 152, coupled to a current source 160. A controller 162 is coupled to the current source to control operation of the current source. Controller 162 may be part of or separate from the current source 160. To generate time-varying currents, controller 162 may be a processor. If a constant current is to be generated, the controller 162 may be an on-off switch or have a variable setting, for example. Current flowing through the coil 158 induces a magnetic field in the core 152 and between the pole faces 154, 156. The direction and magnitude of the magnetic field between the pole faces 154, 156 changes as the direction of the current in the coil changes. The electron beam 110 is shown between the pole faces 152, 154.

Figure 4:
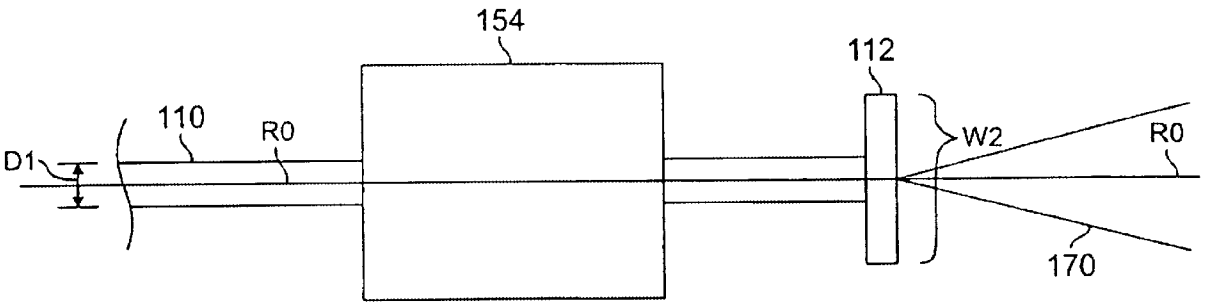
FIG. 4 is a side view of a pole of the electromagnet of FIG. 3 along arrow 4, showing a radiation beam when the electromagnet is not driven by current.

FIG. 4 is a side view of the pole 154 along arrow 4 of FIG. 3. The pole 156 is directly behind the pole 154 and is not indicated in this view. The target 112 is shown, as well. No current is flowing through the coil 158 and there is no magnetic field generated between the pole faces. After acceleration by the accelerator body 110*a* (not shown in this view), the electron beam 110 travels along the central ray R1 and impacts the target 112 along the central ray R0. A radiation beam 170 is generated, centered about the central ray R0. The radiation beam 170 may be collimated to a fan beam of a desired angle, such as about 20 degrees. The radiation beam 170 has its peak intensity M along the central ray R0, as shown in FIG. 7.

Figure 5:
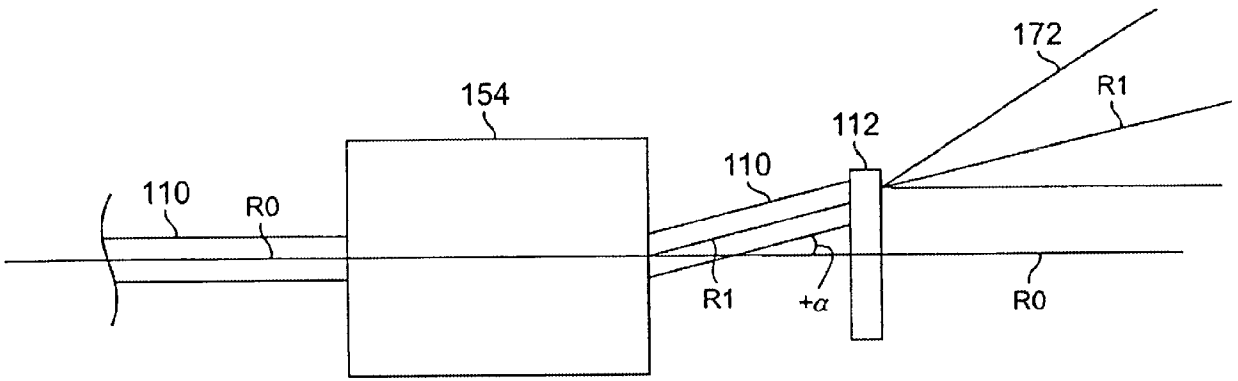
FIG. 5 is a side view of the pole, as in FIG. 4, and a resulting deflected radiation beam, when the electromagnet is driven by a current in a first direction.

FIG. 5 is a side view of the pole 154 along arrow 4 of FIG. 3, when an alternating current is flowing through coil 158 in a first direction. A magnetic field flows from the pole 156 to the pole 154 in FIG. 3. The electron beam 110 is deflected by the magnetic field along a first deflected central ray R1 at an angle $+\alpha$ with respect to the central ray R0. The electron beam 110 impacts the target 112 along the first deflected central ray R1, causing generation of a radiation beam 172 centered about the first deflected central ray R1. The radiation beam 172 may be collimated to a fan beam of a desired angle, such as about 20 degrees. The radiation beam 172 has a peak intensity M along the first deflected central ray R1, as shown in FIG. 7.

Figure 6:
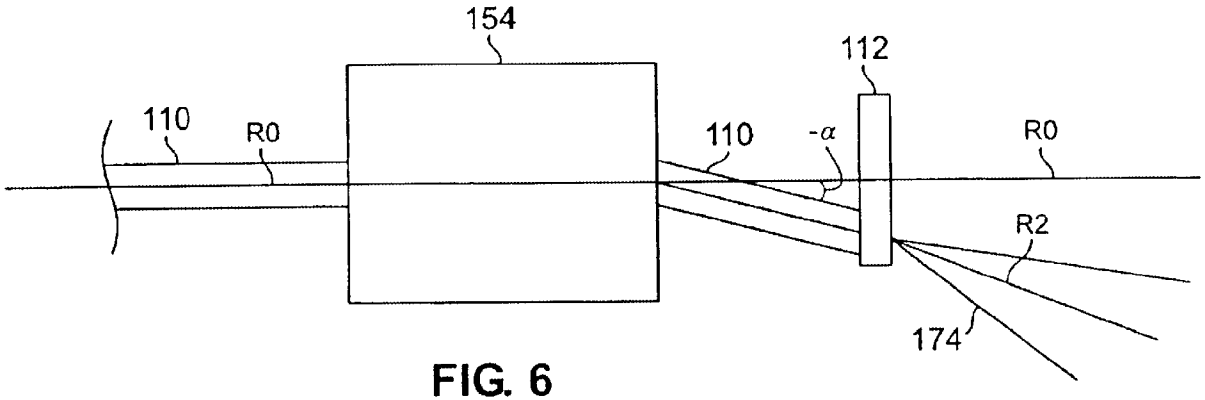
FIG. 6 is a side view of the pole, as in FIG. 4, and a resulting deflected radiation beam, when the electromagnet is driven by a current in a second direction (opposite the first direction)

FIG. 6 is a side view of the pole 154 along arrow 4 of FIG. 3, when an alternating current is flowing in a second direction (opposite the first direction). A magnetic field flows from the pole 154 to the pole 156 in FIG. 3. The electron beam is deflected by the beam along a second deflected central ray R2 at an angle $-\alpha$ with respect to the central ray R0. The electron beam 110 impacts the target 112 along the second deflected ray R2 and a radiation beam 174 is generated, centered about the second deflected central ray R2. The radiation beam 174 may be collimated to a fan beam of a desired angle, such as about 20 degrees, for example. The peak intensity M of the radiation beam 174 is along the second deflected central ray R2, as is also shown in FIG. 7.

Figure 7:
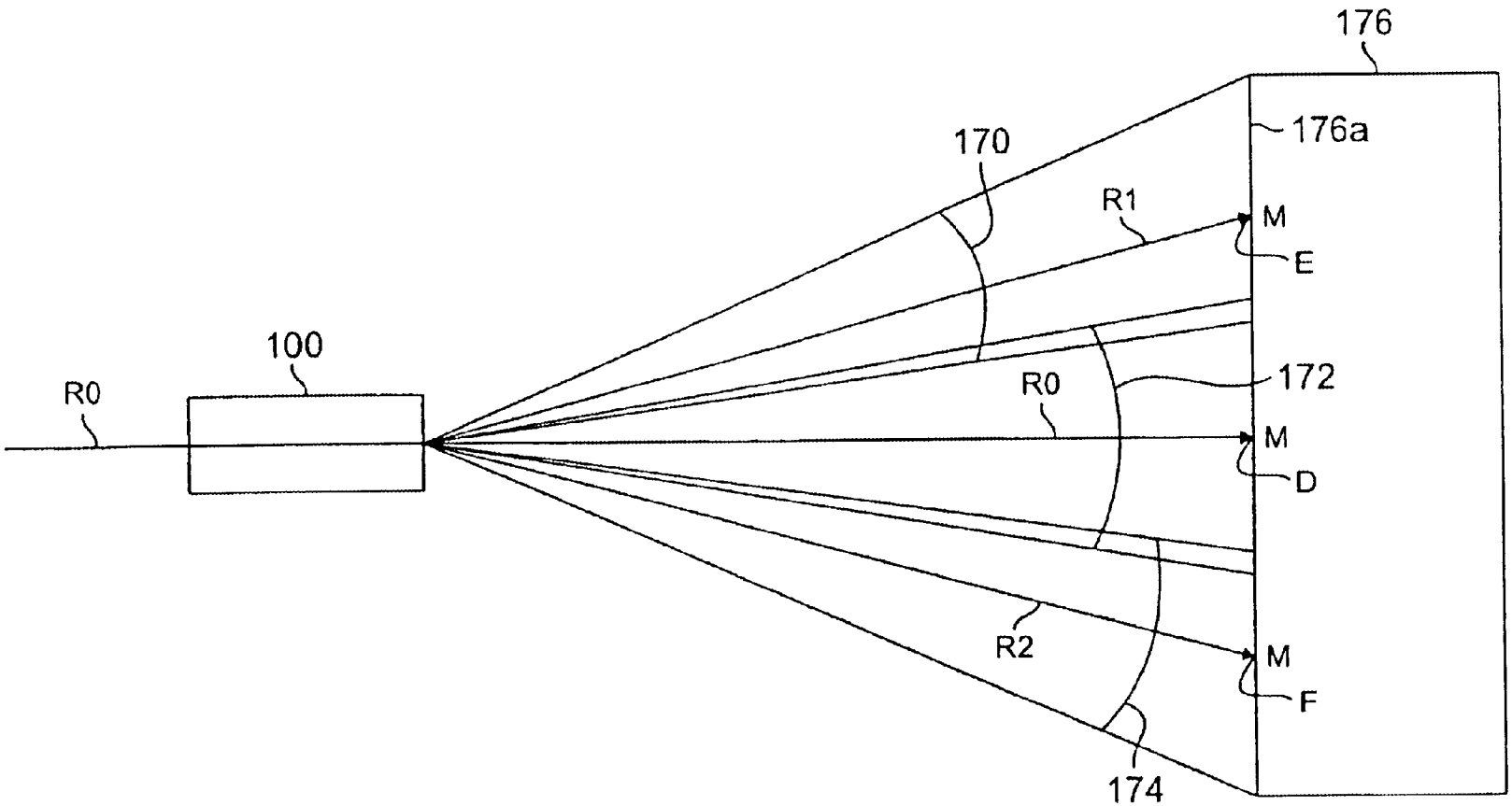
FIG. 7 shows the radiation beams of FIGS. 4–6, generated by the source in accordance with the embodiment of FIG. 3, illuminating a face of a cargo conveyance.

FIG. 7 shows the radiation beams 170, 172, 174 centered about the three central rays R0, R1, R2, respectively generated by the source 100 in accordance with this embodiment of the invention, illuminating a face 176*a* of a cargo conveyance 176. Each beam extends over an angle of about 20 degrees, for example. Preferably, the beams overlap their coverage of the face 176*a*, to ensure that the face is completely illuminated. Since each beam 170, 172, 174 need only illuminate a portion of the face 176*a* of the cargo conveyance 176, it may be emitted over a smaller angle than would a single beam, as in the prior art of FIG. 1. The intensity drop across each beam as the angle from each respective central ray increases, will therefore be less than when a single beam is used. Three points D, E, F, on the face 176*a* each receive the peak intensity M of radiation and remaining portions of the face, which are closer to a point of peak intensity than in the prior art, will also receive radiation having higher intensities. In addition, where a plurality of beams are used to illuminate an object face, the sources may be closer to the object than when a single source must illuminate the entire object face. The intensity drop caused by distance is therefore less, as well.

Figure 8:
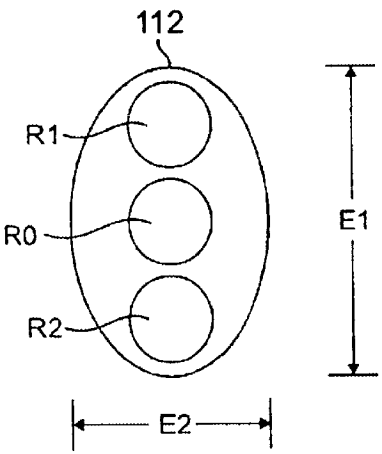
FIG. 8 is a front view of a target for use in the embodiment of FIG. 3.

In FIGS. 4–6, the diameter D1 of the electron beam 110 and the width W2 of the target 112 are exaggerated for ease of illustration. A typical diameter D1 for the electron beam 110 is from about 1 to about 3 mm. A typical width W2 for a disc shaped target is from about 2 to about 5 mm. To accommodate the deflection of the electron beam 110, the target 112 may be shaped like an ellipse, as shown in FIG. 8. If the electron beam 110 has a diameter D1 of about 1 mm, the ellipse may have a long axis E1 of from about 5 to about 6 mm, and a short axis E2 of about 2 mm, for example. Examples of impact locations of the electron beam 110 along central rays R0, R1, R2, are shown. The impact locations may or may not overlap.

The magnetic field may be rapidly cycled from being off, as in FIG. 4, to generating a magnetic field from pole 156 to pole 154 to cause a positive deflection, as in FIG. 5, to generating a magnetic field from pole 154 to pole 156 to cause a negative deflection, as in FIG. 6, and back to being off, under the control of processor 162. For example, one cycle (off-positive deflection—negative deflection—off) can take about 20 milliseconds. The frequency of the cycles may therefore be about 50 hertz.

Figure 9:
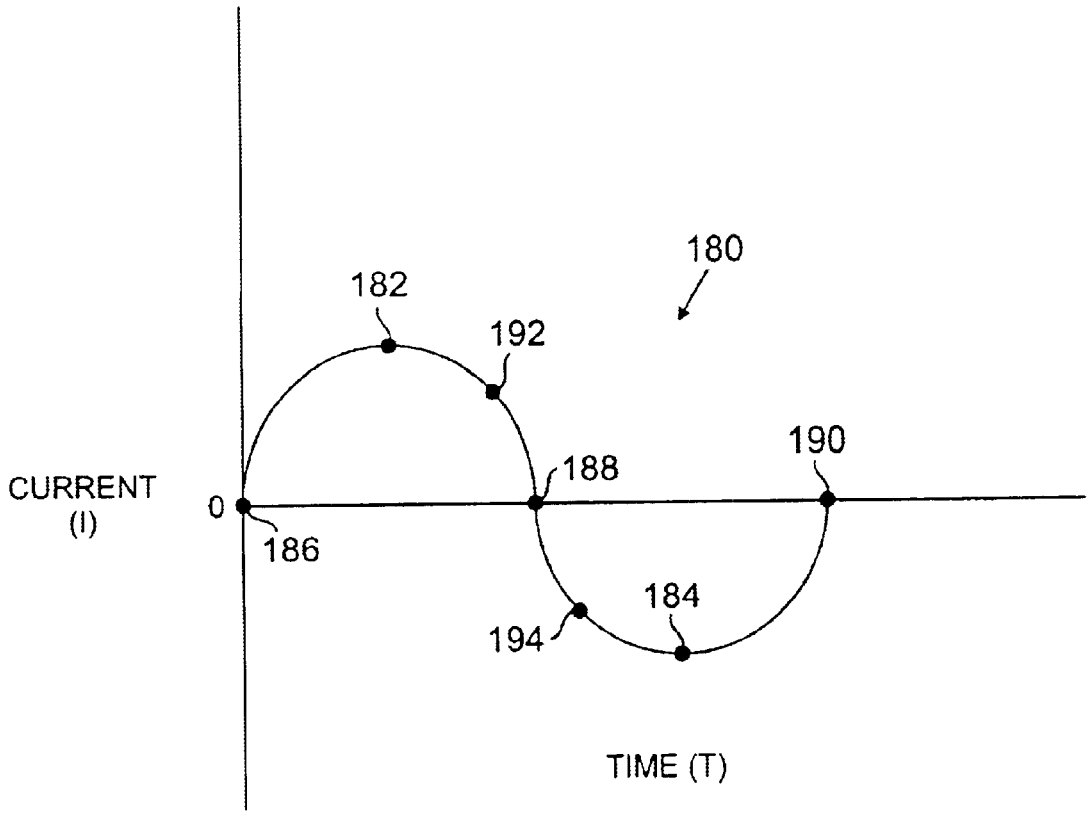
FIG. 9 is a graph of Current (I) versus Time (T), showing an example of a sinusoidally varying current.

FIG. 9 is a graph of current (I) versus time (T), showing an example of a sinusoidally time-varying current 180 generated by current source 160 under the control of controller 162 in FIG. 3. The maximum 182, minimum 184 and zero points 186, and of the; current 180 may be coordinated with respective pulses of a linear accelerator, such as a LINAC®, for example, to cause generation of electron beams at those respective points. Such electron beam would be undeflected at Points 186, (as in FIG. 4), deflected positively at Point 182 (as in FIG. 5) and negatively at Point (as in FIG. 6), respectively, for example. A LINAC® may emit pulses every 20 milliseconds, at a frequency of 50 hertz, for example. The pulses need not be emitted at the maximum, minimum and zero points of the curve of the current. The pulses may be emitted at any desired points along the curve.

Figure 1:
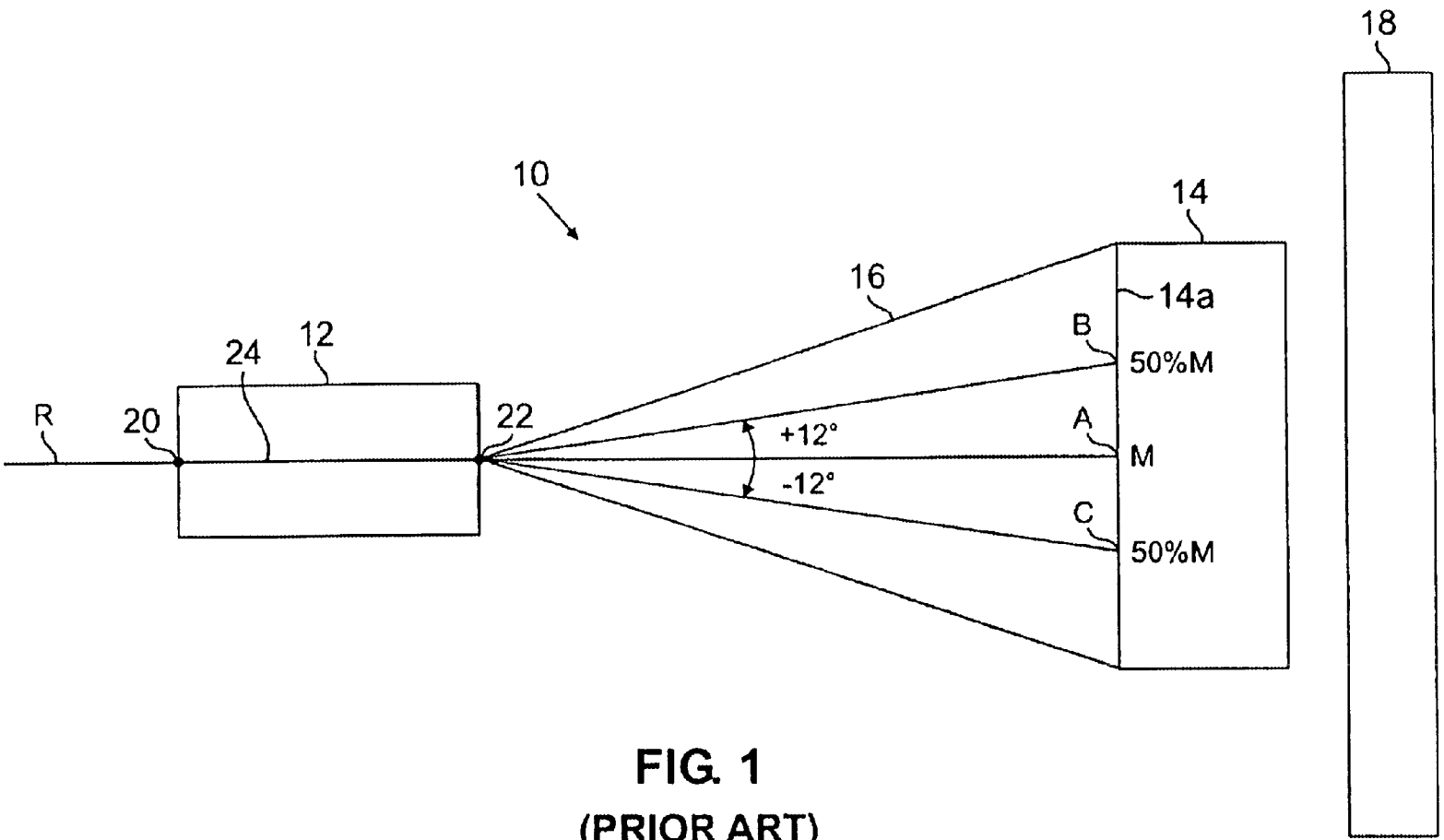
FIG. 1 (PRIOR ART)
FIG. 1 is a schematic diagram of a prior art radiation scanning system including a radiation source scanning an object with a vertically diverging fan beam of radiation.

By rapidly deflecting the electron beam 110, and thereby the central rays R0, R1, R2 of the resulting radiation beams, more of the face 176*a* of the cargo conveyance 176, or other such object, may be exposed to the highest intensity radiation and overall, the face may be exposed to higher radiation intensity than if a single radiation beam is used to illuminate the entire face, as in the prior art of FIG. 1.

While three beams will generally be sufficient, more beams may be used, particularly for larger objects. For example, 5 beams may be used to irradiate a cargo conveyance having a height of about 8 feet (2.4 meters) with a vertical fan beam. For example, two additional radiation beams, one between central rays R0 and R1, and one between central rays R0 and R2, may be generated at points 192 and 194 on the curve of FIG. 9, respectively. Two beams may also provide some improvement, particularly for smaller objects. The angular range over which the radiation intensity will be within 50% of the maximum radiation intensity on the face of the cargo conveyance 176 may be increased two or more times in accordance with this embodiment, depending on the number of deflected beams. The entire face of the cargo conveyance 176 may thereby be irradiated with radiation within 50% of the maximum radiation, without having to distance the radiation source 100 as far from the cargo conveyance, as in the prior art.

The angle of the electron beam may also be continuously shifted between a maximum positive deflection $+\alpha$ and a maximum negative deflection $-\alpha$ by applying a time varying current to the coil 158 to generate a time varying magnetic field, under the control of processor 162. The time varying current and resulting time varying magnetic field may be sinusoidal, for example. Each point on the face 176*a* of the cargo conveyance 176 may then be exposed to the maximum intensity M.

Figure 10:
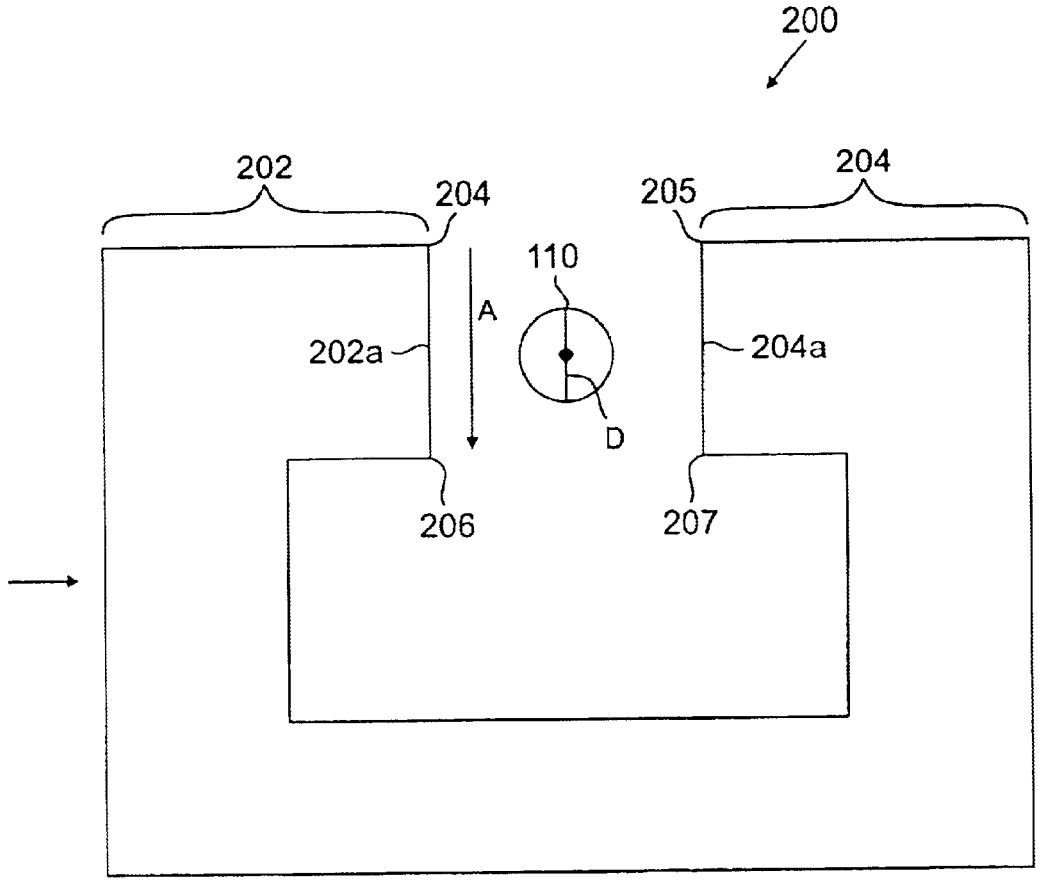
FIG. 10 is a front view of an example of a permanent magnet, for use in another embodiment of the invention.

The magnet 116 may also be a permanent magnet, generating a time-invariant (constant) magnetic field. In this case, the generated magnetic field varies spatially across the electron beam 110 to cause a differential variation in deflection of the electron beam. The permanent magnet may be a horseshoe magnet having the same or similar shape as the core 152 in FIG. 3, for example. The magnet may have other shapes, as well. FIG. 10 is a front view of an example of such a permanent magnet 200, with pole portions 202, 204 having opposing pole faces 202*a*, 204*a*. The permanent magnet 116 may also comprise a pair or a plurality of pairs of permanent magnets, with facing pole portions. The permanent magnet may be a ferromagnetic material, such as iron, cobalt and nickel, for example.

Figure 11:
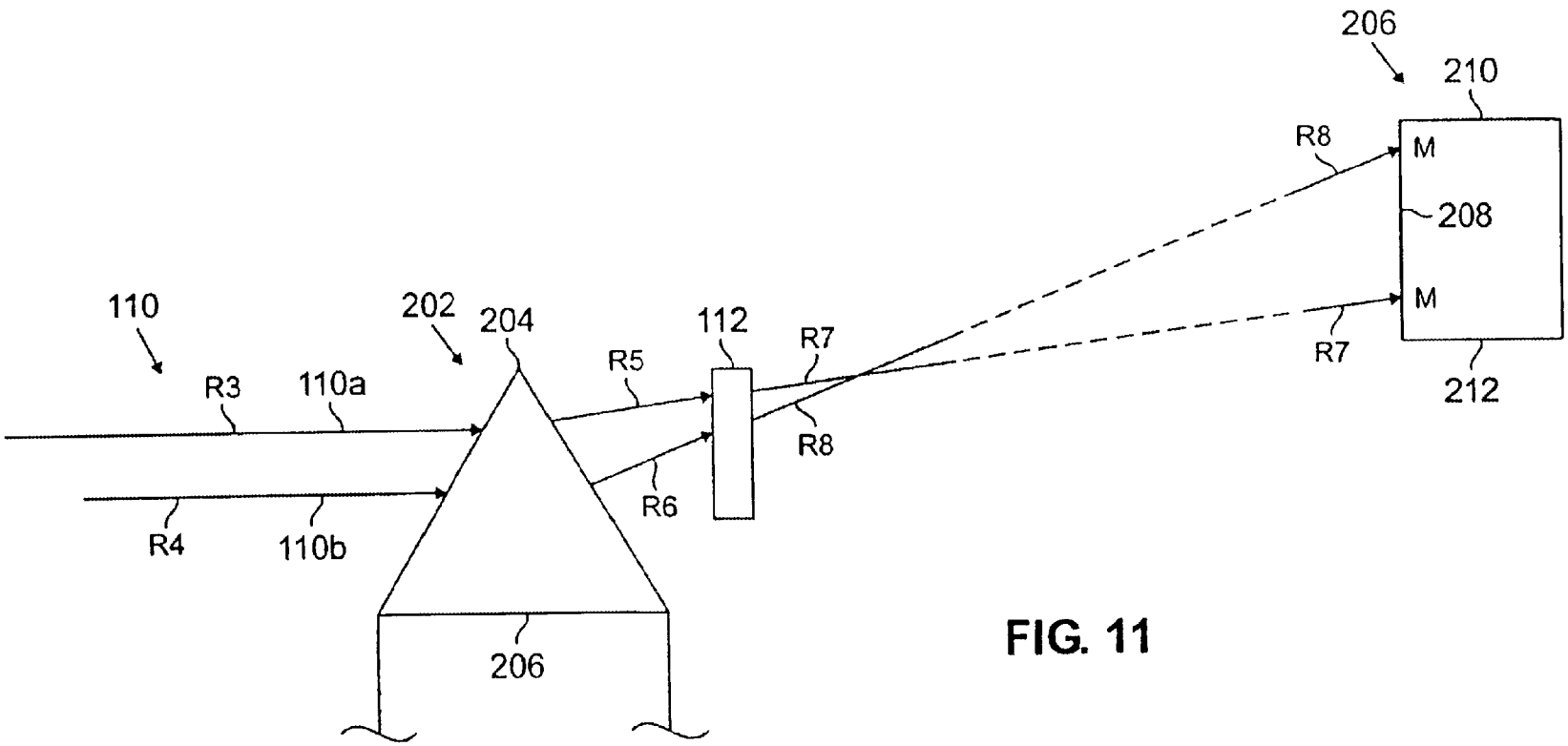
FIG. 11 a side view along the poles of a permanent magnet, of the embodiment of FIG. 10, showing a triangular shaped pole and resulting deflected electron beam.

A magnetic field that varies spatially across the beam 110 may be generated in a variety of ways. For example, a spatially inhomogeneous magnetic field may be generated by a permanent magnet with irregularly shaped poles. FIG. 11 a side view along the poles of a horseshoe shaped permanent magnet, similar to the side views of FIGS. 4–6, showing a triangular shaped pole 202. The opposing pole behind pole 204 cannot be seen in this view. An electron beam 110, a target 112 and a cargo conveyance 206 are also shown in FIG. 11.

The magnetic field generated between the pole faces 202*a*, 202*b* is uniform. However, different portions of an electron beam 110 passing through the space will have different path lengths through the magnetic field. For example, in FIG. 11, uppermost portion 110*a* of the electron beam 110 will have a shorter path length through the magnetic field than lowermost portion 110*b*. Central ray R3 of the uppermost portion 110*a* and central ray R4 of the lowermost portion R4 are also shown. Since the degree of deflection of the electron beam 110 by a magnetic field is dependent in part on the path length through the field, the uppermost portion 110*a* of the electron beam 110 will be deflected (along a deflected central ray R5) less than the lowermost portion 110*b* is deflected (along a deflected central ray R6). Since the path length through the magnetic field increases along arrow A in the space between pole faces 202*a*, 204*a* (See FIG. 10), from the vertices 204, 205 of the pole faces 202*a*, 204*a* to the lower surfaces 206, 207 of the pole faces, the degree of deflection of the electron beam 110 increases across the diameter "D" of the electron beam 110 (from an upper point 110*a* of the electron beam to a lower point 110*b* of the beam) along arrow A, as well. The uppermost portion 10*a* may be deflected about 5 degrees while the lowermost portion 110*b* is deflected about 20 degrees, for example. The deflections are upward in this configuration. Therefore, the portions 110*a*, 110*b* converge. The portions of the electron beam between the uppermost portion and lowermost portions are deflected to intermediate degrees, dependent on the respective path lengths.

The impact of the uppermost portion 110*a* and lowermost portion 110*b* of the electron beam on the target 112 generates radiation beams having deflected central rays R7, R8, respectively, aligned with deflected central rays R5, R6. The radiation beam centered about the central rays R7, R8, have peak intensities M. The radiation along the central rays R7, R8 will preferably impact a face 208 of a cargo conveyance 206 at or near the sides 210, 212 of the conveyance. The intermediate portions of the electron beam 110 will also cause generation of central rays of radiation (not shown) that will impact the face 208 of the cargo conveyance 206 at locations between the central rays R7, R8. The entire face 208 may thereby be illuminated with substantially uniform intensity M. Here, "substantially uniform intensity" means that the intensity is uniform at the face 208 of the cargo conveyance 206 within the tolerances of the radiation source, including the magnet.

Figure 12:
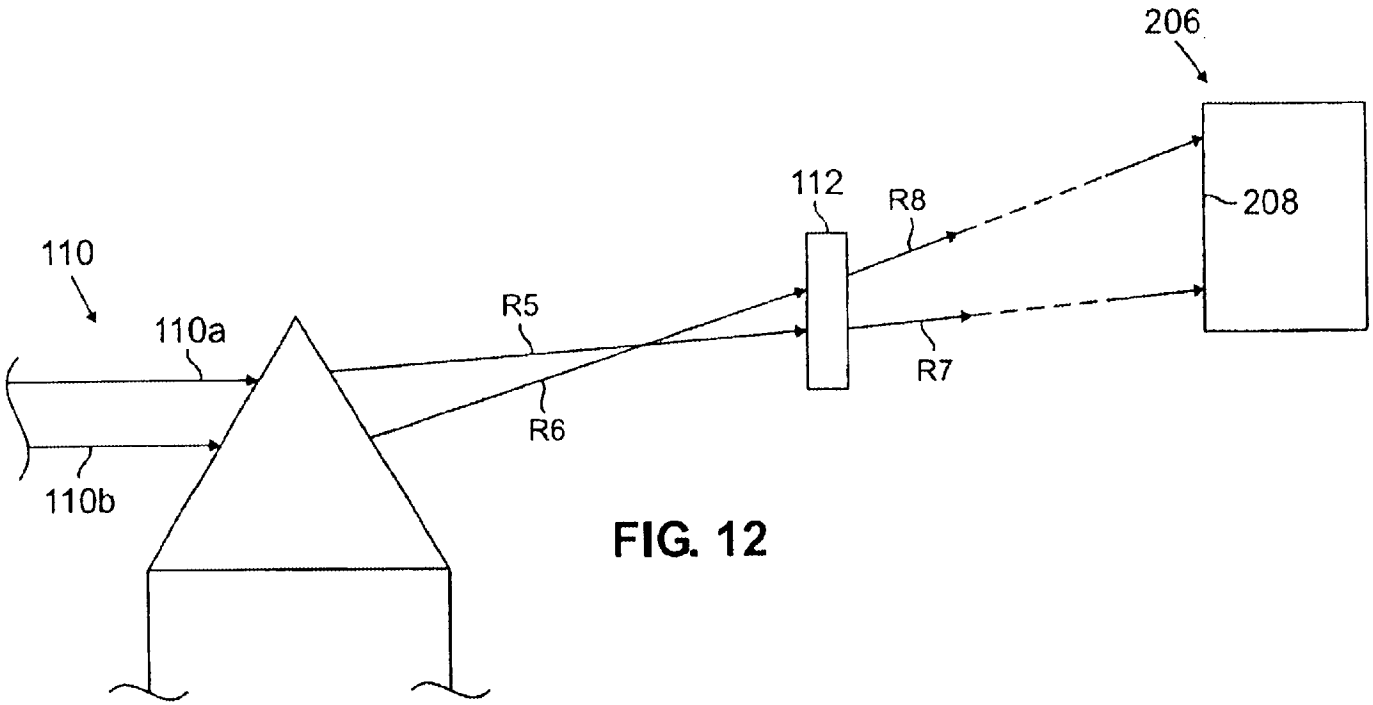
FIG. 12 is a side view as in FIG. 11, showing the uppermost and lowermost portions of the electron beam crossing-over each other prior to impacting the target.

In the configuration of FIG. 11, the central rays R7, R8 cross-over each other prior to illuminating the cargo conveyance 203. The deflection may alternatively cause the uppermost and lowermost portions 110*a*, 110*b* of the electron beam 110 to cross-over each other prior to impacting the target 112, as shown in FIG. 12, dependent on the relative strength of the magnetic field, the path lengths, and the relative locations of the pole face 202, the target 112 and the cargo conveyance 203. In other arrangements, neither the portions 110*a*, 110*b* of the electron beam 110 nor the central rays of radiation R7, R8 cross over.

Figure 13:
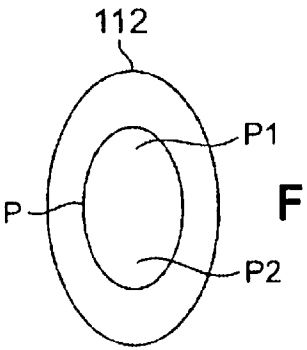
FIG. 13 is a front view of an elongated target for use in the embodiment of FIG. 10.

It is preferred that the converging electron beams not be focused onto a single point on the target 112, to avoid burning the target. The converging beams may converge upon a focal point on the target 112, from about 1 mm to about 2 mm, for example, to avoid burning the target 112. The target 112 may be elongated to accommodate a wider focal point, as shown in FIG. 13. In FIG. 13, the target 112 is elliptical, as is the focal point P. It may have other shapes, as well, such as rectangular. The focal point P is shown, as well. The focal point P may be elliptical, for example.

While the focal point P may be elongated, X-ray radiation received by the face 208 is emitted by only a portion of the focal point P. For example, radiation emitted along ray R8 and impacting the upper portion of the face 208, is emitted mainly from an upper portion P1 of the focal spot P impacted by a portion of the electron beam 110*b* along ray R6. Similarly, radiation emitted along ray R7 is generated primarily by the impact of a portion 110*a* of the electron beam 1110 along ray R5 on the lower part P2 of the focal point P. Therefore, even if the focal spot is spread out by the divergence of the electron beam by the magnetic field, each section of the face 208 will only be illuminated by radiation emitted from a smaller portion of the focal spot. The effective focal point for portions of the radiation beam is therefore smaller than the actual focal point P, and the spatial resolution of an image of the cargo conveyance 206 irradiated by the beam will not be degraded.

Figure 14:
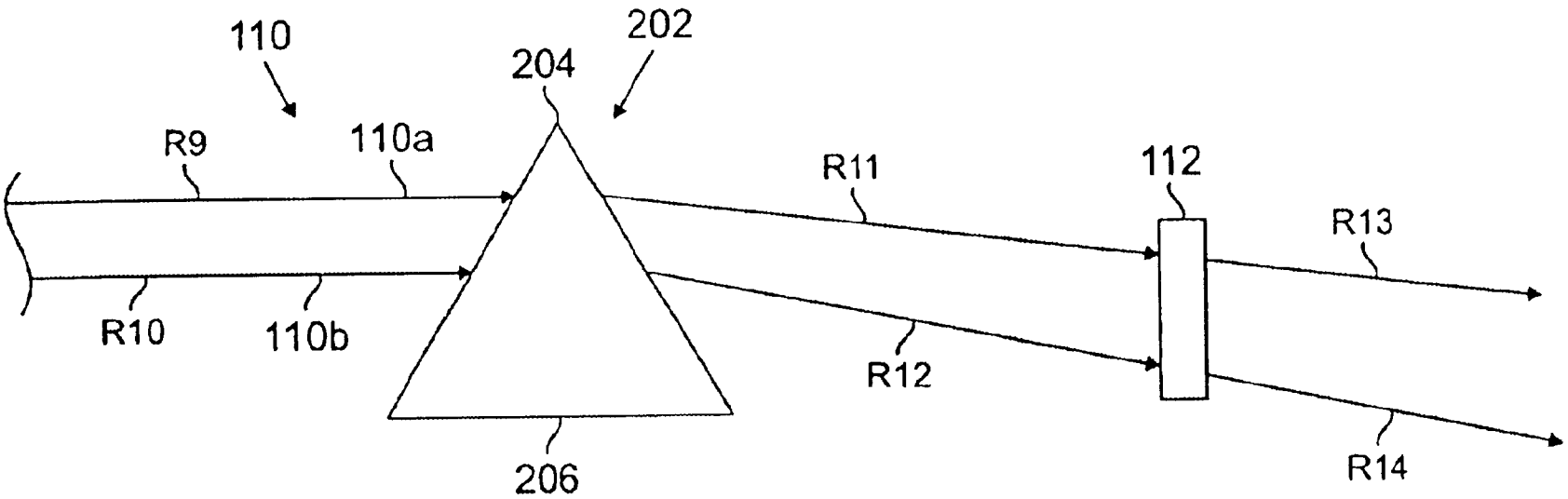
FIG. 14 is a side view as in FIGS. 11 and 12, where the polarity of the magnet is reversed, showing the electron beam deflected downward and diverging.

If the polarity of the magnet 200 is reversed, the electron beam 110 will be deflected downward and will diverge, as shown in FIG. 14. The uppermost portion 110*a* of the electron beam 110, traversing central ray R9, will be deflected downward less than the lowermost portion 110*b*, traversing central ray R10. The uppermost portion 110*a* may be deflected an angle of $-\alpha 1$ degrees along deflected central ray R11, for example, while the lowermost portion 110*b* may be deflected an angle of $-\alpha$ degrees, along deflected central ray R12, for example. Impact of the electron beam along central ray R11 upon the target 112 will generate a radiation beam having a central ray R13. Impact of the electron beam along central ray R12 will generate a radiation beam having a central ray R14. The source 100 and the cargo conveyance 206 are not shown in this view, but it is apparent the source may be positioned with respect to the conveyance so that the radiation beams centered about the central rays R13, R14 will illuminate the front face of the conveyance at or near the side walls of the conveyance, as in FIG. 10. Portions of the electron beam 110 between the uppermost and lowermost portions 110*a*, 110*b* will be deflected to a gradually increasing degree across the beam for the uppermost to lowermost portion, illuminating the remainder of the face 208 of the cargo conveyance 206. Preferably, the target 112 is elongated, as in FIG. 11, to accommodate an elongated focal spot. As above, the effective focal point of impact by portions of the electron beam 110 generating the radiation beam will be smaller than the actual focal point on the target 112, minimizing any negative impact on spatial resolution of an image of the cargo conveyance 206 irradiated by the beam.

Figure 15:
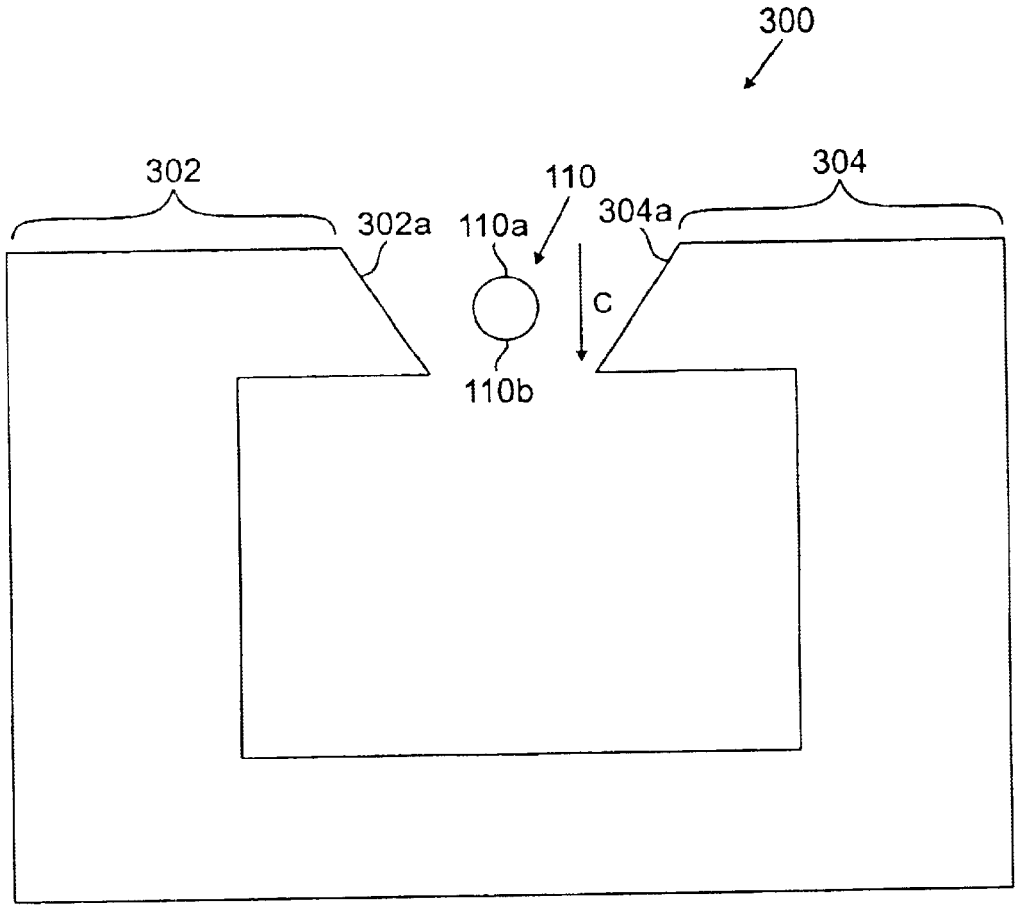
FIG. 15 is a front view of a permanent magnet with pole portions having opposing, inwardly tapered pole faces.

Non-uniform magnetic fields may also be generated by varying the distance between pole faces. FIG. 15 is a front view of a permanent magnet 300 with pole portions 302, 304 having opposing pole faces 302*a*, 304*a*, respectively. The pole faces are tapered towards each other. The taper is an inward taper from an upper portion to a lower portion of each face 302, 304 along arrow in FIG. 15. The taper may be reversed, as well.

The closer the pole faces 302*a*, 304*a*, the stronger the magnetic field. In FIG. 13, the upper portion of the electron beam 110*a* is exposed to a weaker magnetic field, and is deflected less, than a lower portion 110*b* of the beam. Depending on the direction of the magnetic field, the electron beam 110 will be deflected upwardly and converge, or be deflected downwardly and diverge. As above, the electron beam 110 is dispersed by the non-uniform bending of the beam, broadening the focal spot. X-ray radiation is therefore emitted by only a portion of the focal spot. The effective focal spot is therefore smaller than the actual focal spot.

Both irregularly shaped poles and varying distances between poles may be used to control the deflection of the electron beam, as well.

Magnets 200 and 300 of FIGS. 10 and 15 may be electromagnets, as well, such as electromagnet 150 in FIG. 3. In this case, current source 160 may generate a constant current, under the control of controller 162. Spatial variation of the magnetic field in the space between the pole faces 202*a*, 204*a* and 302*a*, 304*a* may be created, as described above with respect to FIGS. 10–15, for example.

In addition, magnet 150 in FIG. 3 may be a permanent magnet. The constant magnetic field established by the permanent magnet 150 may be varied by superimposing a time-varying magnetic field over the constant magnetic field. For example, current source 160 may provide a time-varying current in coil 158 (see FIG. 9) that will induce a magnetic field varying about the magnitude of the constant magnetic field.

Figure 16:
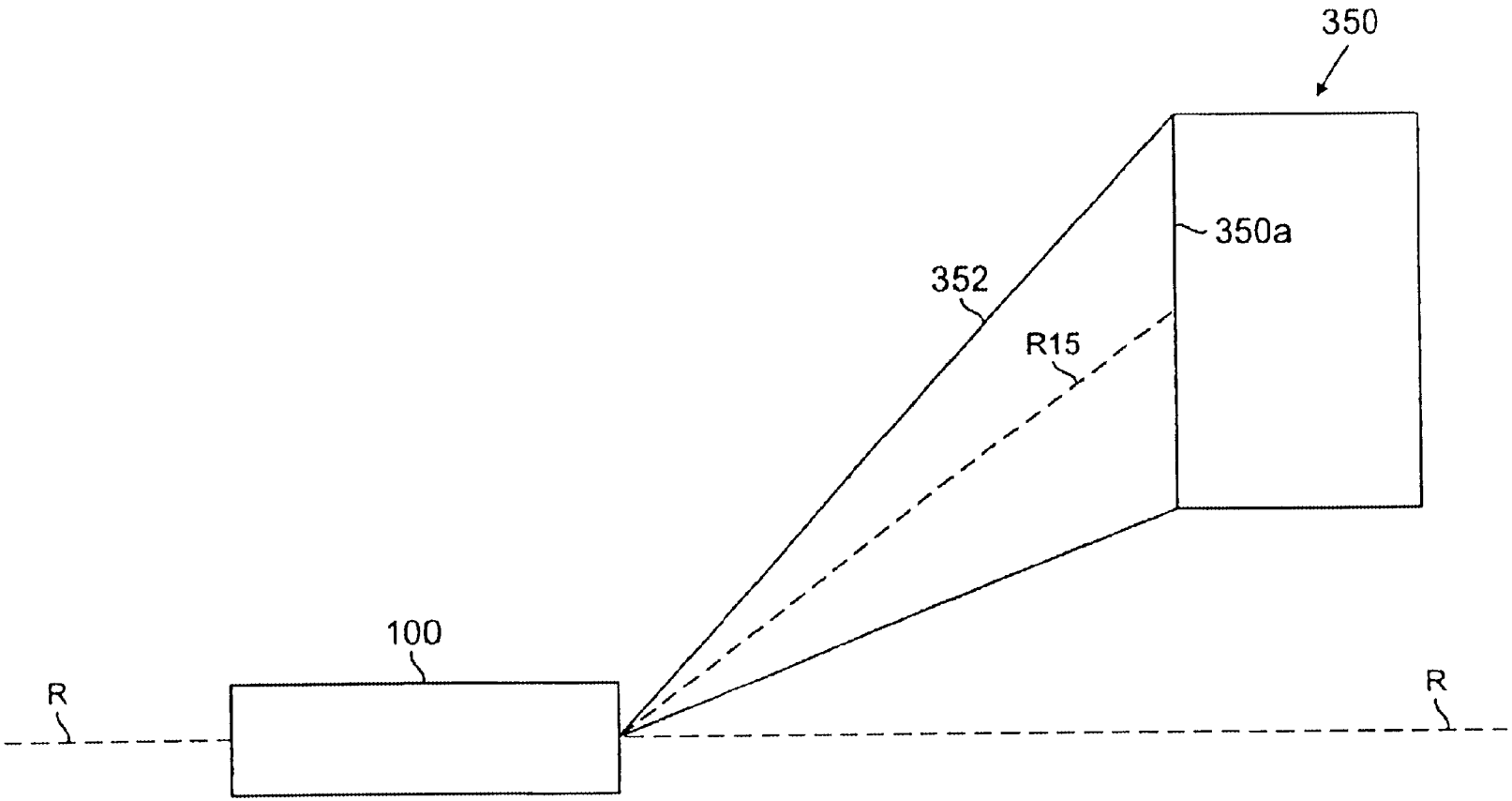
FIG. 16 is a top view of a radiation source illuminating a face of a cargo conveyance with a radiation beam, where an axis of the source is not aligned with the cargo conveyance.

The average direction of a radiation beam may also be shifted. FIG. 16 is a top view of a source 100 illuminating a face 350*a* of a cargo conveyance 350 with a radiation beam 352, where a longitudinal axis R of the source is not aligned with, and may not even intersect, the cargo conveyance. A central ray R15 of the radiation beam 352 may be directed along an axis transverse to the longitudinal axis R, towards the cargo conveyance 350. This may be advantageous where space limitations prevent such alignment. For example, a deflection of the central ray R15 of about 30 degrees may be useful in certain configurations.

An electromagnet with a permanent magnet core may be used to shift the average beam direction and provide improved uniformity of radiation beam intensity across the face of an object. The permanent magnetic field generated by the permanent magnet may cause the shift in the average direction of the magnetic field while the induced, time-varying magnetic field may shift the central ray of the radiation beam about the average direction of the radiation beam.

In the embodiments above, to cause a 20 degree deflection in the electron beam (or a portion thereof) with a path length of about 1 cm through a magnetic field, for example, a magnetic field strength of about 1800 Gauss would be required. If the path length is about 2 cm, the field strength could be about 900 Gauss. Standard permanent magnets could be used.

Figure 17:
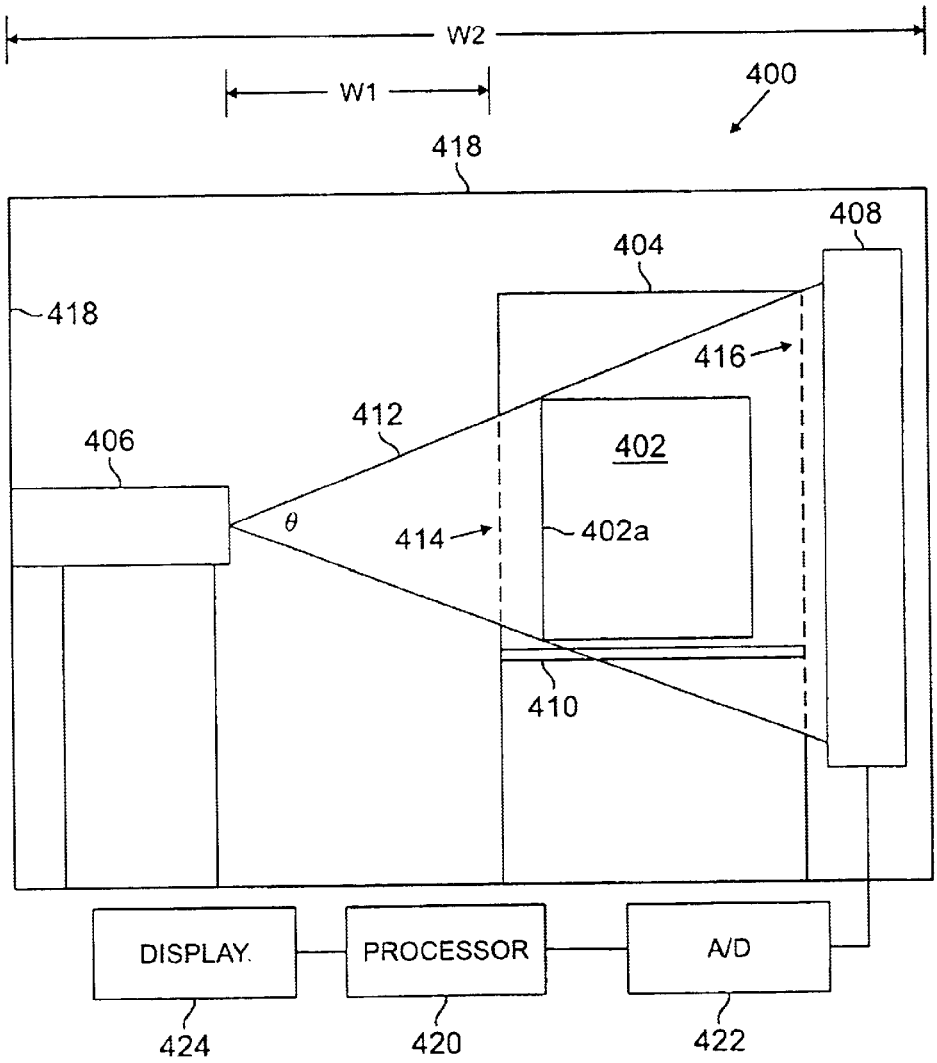
FIG. 17 is a front view of an X-ray scanning system in accordance with an embodiment of the invention.

FIG. 17 is a front view of an example of an X-ray scanning system 400 in accordance with an embodiment of the invention. A cargo conveyance 402 or other such object to be inspected is conveyed through a shielded tunnel 404 between a radiation source 406, in accordance with an embodiment of the invention, and a stationary detector array 408 by a conveying system 410. The radiation source 406 may be any of the radiation sources discussed above. The radiation beam is collimated into a vertical fan beam 412. Windows 414, 416 are provided in the walls of the tunnel 404 to allow for the passage of radiation to the cargo conveyance 402 from the source 406 and from the cargo conveyance 402 to the detector array 408. The detector array 408 may also be provided within the shielded tunnel 404, in which case only one window 414*a* would be required. The conveyor system 410 may comprise a mechanically driven belt of material that causes low attenuation of the radiation. The conveyor system 410 can also comprise mechanically driven rollers, with gaps in the rollers to allow for the passage of the radiation. Shielding walls 418 surround the source 406, the detector 408 and a portion of the conveying system 410. Openings (not shown) are provided in the shielding walls 418 for the cargo conveyance 406 to be conveyed into and out of the scanning system 400 by the conveying system 410. A second stationary source in accordance with the invention (not shown) may be provided above the conveying system 410 and a second stationary detector (not shown) may be provided below the conveying system (or vice-a-versa), to examine the object 10 from another angle. Radiation source 406 may emit radiation at multiple energies, if desired. Detectors may be positioned in other locations with respect to the cargo conveyance 402 instead of or in addition to the detector array 408, to detect scattered radiation.

The detector 408 is electrically coupled to a processor 420, such as a computer, through an analog-to-digital converter 422. The processor 420 reconstructs the data output by the detector array 408 into images which may be displayed on a monitor 424 on site or at another location. The images may be analyzed to detect contraband, such as guns, knives, explosive material, nuclear material and drugs, for example. The images may also be used for manifest verification, for example. While one processor 420 and A/D converter 422 are shown, additional processors, A/D converters, and other signal processing circuits may be provided, as is known in the art.

To detect a fan beam, the detector 408 may be a one dimensional detector array comprising modules of detector elements, as is known in the art. Each one dimensional detector module may comprise a single row of a plurality of detector elements. The detector elements may comprise a radiation sensitive detector, such as a scintillator, and a photosensitive detector, such as a phototube or photodiode, as is known in the art. A high density scintillator, such as a cadmium tungstate scintillator, may be used. A cadmium tungstate scintillator is available from Saint Gobain Crystals, Solon, Ohio, U.S.A., or Spectra-Physics, Hilger Crystals, Kent, U. K., for example, with a density of 8 grams per cubic cm. Detector modules having detection efficiencies of from about 10% to about 80% or more are preferably used, depending on the radiation spectrum of the radiation beam 412. Multiple, closely spaced, parallel fan beams may also be defined by one or more collimators. In that case, a row of one dimensional detectors may be provided for each fan beam.

Instead of a fan beam, the radiation beam may be collimated into a cone beam, in which case the detector 408 may be a detector array comprising two dimensional detector modules.

In one example, the source 406 is separated from a face 402*a* of the cargo conveyance 402 by a distance W1 of about 2.5 feet (0.8 meters). The cargo conveyance 402 has a height of about 8 feet (2.4 meters). A vertical fan beam 412 of radiation may be emitted over an angle θ of about 120 degrees by the source 406 to irradiate the face 402*a* of the cargo conveyance 402 as the conveyance passes though the vertical fan beam. Intensity variation across the height of the cargo conveyance may be less than 50% and/or the intensity may be substantially uniform, depending on the configuration of the radiation source 406, as discussed above. The width W2 of the system 400 may be about 16.5 feet (about 5.03 meters), for example. The peak energy of the radiation source may be dependent on the size of the cargo conveyance. For example, if the cargo container has a thickness of about 8 feet (2.4 meters), the peak energy may be 6 MeV or greater. A comparable prior art system could have a comparable width of about 34 feet (10.4 meters) or more.

One of ordinary skill in the art will recognize that changes may be made to the embodiments described herein without departing from the scope of the invention, which is defined by the claims, below.

What is claimed is:

1. A radiation source comprising:

a housing;

a first, accelerating chamber within the housing, to accelerate a beam of charged particles, the first chamber having an output;

a second chamber within the housing, the second chamber having an input aligned with the output of the first chamber to receive the beam of accelerated charged particles;

a point target supported within the second chamber, wherein impact of the target by the accelerated charged particles causes generation of radiation; and a magnet supported by the housing proximate the second chamber, to provide a magnetic field to deflect at least a portion of the beam of accelerated charged particles prior to impacting the target, the magnet configured to cause a change in an angle of impact of the at least a portion of the beam on the target.

2. The radiation source of claim 1, wherein the magnet provides a time-varying magnetic field during operation.

3. The radiation source of claim 2, wherein the magnet is an electromagnet.

4. The radiation source of claim 3, wherein the electromagnet comprises:

a core defining first and second opposing pole faces, wherein the core comprises material in which a magnetic field may be induced;

a coil around at least a portion of the core;

a current source coupled to the coil; and a controller coupled to the current source.

5. The radiation source of claim 4, wherein the core comprises a magnetic material.

6. The radiation source of claim 4, wherein the controller selectively causes current flow in at least a first direction to provide a magnetic field to deflect the beam along a first axis.

7. The radiation source of claim 6, wherein the controller selectively causes current flow in a second direction opposite the first direction, to generate a second magnetic field to deflect the beam along a second axis.

8. The radiation source of claim 7, wherein the controller selectively causes no current flow, to allow the beam to travel undeflected, along a third axis.

9. The radiation source of claim 8, wherein the controller is programmed to repeatedly cycle among causing current flow in the first direction, causing current flow in the second direction and causing no current flow.

10. The radiation source of claim 6, wherein the controller selectively causes no current flow, to allow the beam to travel undeflected, along a second axis.

11. The radiation source of claim 1, wherein the magnet provides a constant magnetic field.

12. The radiation source of claim 11, wherein:

the magnet has opposing pole portions;

the beam of charged particles travels along a path between the opposing pole portions;

the beam of charged particles has a width; and the pole portions are configured such that portions of the beam have different path lengths through a magnetic field provided between the pole portions, across the width of the beam.

13. The radiation source of claim 12, wherein the pole portions are irregularly shaped.

14. The radiation source of claim 13, wherein the pole portions are triangular.

15. The radiation source of claim 14, wherein the pole portions are separated by a varying distance.

16. The radiation source of claim 12, wherein:

the portions of the beam are differentially deflected by the magnetic field, based, at least in part, on the respective different path lengths.

17. The radiation source of claim 11, wherein the magnet is a permanent magnet.

18. The radiation source of claim 11, wherein the magnet is an electromagnet.

19. The radiation source of claim 1, wherein:

the first chamber and the second chamber have aligned longitudinal axes along which the beam travels; and the target is aligned with the longitudinal axes.

20. The radiation source of claim 1, further comprising:

a source of a beam of charged particles supported by the housing to emit the beam into the first chamber.

21. The radiation source of claim 19, wherein:

the source of charged particles is a source of a beam of electrons; and impact of the target by the beam causes generation of X-ray radiation.

22. The radiation source of claim 1, wherein the target is tungsten.

23. The radiation source of claim 1, wherein the target is elongated along a direction of deflection of the beam.

24. The radiation source of claim 1, wherein:

the housing has a longitudinal axis; and the radiation is emitted along a central ray transverse to the longitudinal axis.

25. The radiation source of claim 1, wherein:

the beam has a width; and the deflection of the beam varies across the width.

26. The radiation source of claim 1, wherein:

the magnet selectively deflects the beam onto one of at least one location on the target.

27. A linear accelerator comprising:

a housing;

an accelerating chamber within the housing, the chamber having an output and a first longitudinal axis aligned with the output;

a source of electrons supported by the housing to emit electrons along the first longitudinal axis;

a tube comprising a passage having a second longitudinal axis, the tube having a first end with an input coupled to the output of the chamber such that the second longitudinal axis is aligned with the first longitudinal axis;

a point target supported within the tube, along a path of the electrons, wherein impact of the target by electrons generates X-ray radiation; and a magnet supported by the housing, the magnet having opposing pole portions facing the tube, to provide a magnetic field through the tube, to deflect the electrons prior to impacting the target.

28. The linear accelerator of claim 27, wherein the magnet provides a time-varying magnetic field during operation.

29. The linear accelerator of claim 28, wherein the target comprises a refractory metal.

30. The linear accelerator of claim 27, wherein the magnet provides a constant magnetic field during operation.

31. A radiation source, comprising:

a housing;

a source of a beam of charged particles supported by the housing, to emit the beam along a path;

a point target supported by the housing along the path of the beam, wherein impact of the beam with the target causes generation of radiation; and a magnet supported by the housing between the source and the target, to provide a magnetic field to change an angle of impact of at least a portion of the beam on the target.

32. The radiation source of claim 31, wherein the magnet provides a constant magnetic field.

33. The radiation source of claim 32, wherein the magnetic field varies spatially across a width of the beam.

34. The radiation source of claim 31, wherein the magnet provides a time-varying magnetic field.

35. A system for examining an object, comprising:

a conveyor system to move the object through the system;

a radiation source comprising:

a housing;

a source of a beam of charged particles supported by the housing, to emit the beam along a path;

a point target supported by the housing along the path, wherein impact of the beam with the target causes generation of radiation; and a magnet supported by the housing between the source and the target, to provide a magnetic field to deflect at least a portion of the beam prior to the beam impacting the target, the magnet configured to cause a change in an angle of impact of the at least a portion of the beam on the target material, to cause generation of at least one diverging radiation beam for emission by the source; and a detector positioned to receive radiation after interaction with the object, the detector having a size greater than a size of the target;

wherein:

the radiation source is positioned with respect to the conveying system such that the at least one diverging radiation beam emitted by the source irradiates an object for inspection on the conveying system and is detected by the detector.

36. The system of claim 35, wherein:

the radiation source is on a first side of the conveying system; and the detector is on a second side of the conveying system, to detect radiation transmitted through the object.

37. The system of claim 35, wherein the magnet provides a time-varying magnetic field during operation.

38. The system of claim 35, wherein the magnet provides a constant magnetic field.

39. The system of claim 35, wherein the magnet provides a magnetic field that varies spatially across a width of the beam.

40. The system of claim 39, wherein the radiation irradiates the object with substantially uniform intensity.

41. The system of claim 35, wherein:

the source of charged particles is a source of electrons; and the target material generates X-ray radiation upon impact by the electrons.

42. The system of claim 35, wherein:

the radiation source has a first longitudinal axis; and the radiation is emitted along a central ray transverse to the longitudinal axis, to irradiate an object along the central ray.

43. A method of generating radiation, comprising:

directing a beam of charged particles towards a point target;

deflecting at least a portion of the beam to change an angle of impact of at least a portion of the beam on the point target;

impacting the target by the deflected beam to generate a plurality of first diverging radiation beams, at least some of the first diverging radiation beams having a maximum intensity along a different respective ray originating at the target; and collimating the first diverging radiation beams into a plurality of second diverging radiation beams, each having a predetermined share and having a maximum intensity along the respective different ray.

44. The method of claim 43, comprising deflecting the beam by providing a magnetic field.

45. The method of claim 43, comprising:

deflecting the beam by providing a time-varying magnetic field.

46. The method of claim 43, comprising:

deflecting the beam by providing a constant magnetic field.

47. The method of claim 46, comprising:

deflecting the beam by passing the beam through a magnetic field varying spatially along a width of the beam.

48. The method of claim 43, comprising:

directing the beam along a first axis;

deflecting the beam along a second axis transverse to the first axis;

impacting the target along the second axis; and generating radiation having a central ray along the second axis.

49. The method of claim 43, comprising:

generating X-ray radiation upon impact of the target by the beam.

50. A method of examining contents of an object with a radiation source, the method comprising:

directing a beam of charged particles towards a point target;

deflecting at least a portion of the beam to change an angle of impact of the at least a portion of the beam on the target;

impacting the target by the deflected beam to generate diverging radiation beams;

irradiating the object with the diverging radiation beams; and detecting radiation interacting with the object, by a detector having a size greater than a size of the target.

51. The method of claim 50, comprising deflecting the beam by a time-varying magnetic field.

52. The method of claim 50, comprising deflecting the beam by a constant magnetic field.

53. The method of claim 52, comprising deflecting the beam by a magnetic field varying spatially across a width of the beam.

54. The method of claim 50, wherein the beam is an electron beam, the method comprising:

impacting the target by the electron beam to generate X-ray radiation.

55. The method of claim 50, comprising:

emitting the radiation from a source with a first, longitudinal axis; and irradiating the object with the radiation along a second axis transverse to the first axis.

56. A radiation source, comprising:

a housing;

a source of a beam of charged particles supported by the housing, to emit the beam along a path, the beam having a width;

a point target supported by the housing, wherein impact of the beam with the target causes generation of radiation; and a magnet supported by the housing between the source and the target;

wherein the magnet is configured to differentially deflect the beam across the width.

57. The radiation source of claim 56, wherein:

the magnet generates a magnetic field that varies spatially across the width of the beam.

58. The radiation source of claim 56, wherein the pole portions are separated by a varying distance.

59. The radiation source of claim 56, wherein:

the magnet comprises opposing poles, across which the magnetic field is established;

the path of the beam passes between the opposing pole portions; and the pole portions are configured such that portions of the beam have different path lengths through the magnetic field, across the width of the beam.

60. The radiation source of claim 59, wherein the pole portions are irregularly shaped.

61. A system for examining an object, comprising:

a conveyor system to move the object through the system; and a radiation source comprising:

a housing;

a source of a beam of charged particles supported by the housing, to emit the beam along a path, the beam having a width;

a point target supported by the housing along the path, wherein impact of the beam with the target causes generation of radiation; and a magnet supported by the housing between the source and the target, wherein the magnet is configured to differentially deflect the beam across the width;

a detector positioned to receive radiation after interaction with the object;

wherein:

the radiation source is positioned with respect to the conveying system such that radiation emitted by the source irradiates an object for inspection on the conveying system.

62. The system of claim 61, wherein:

the source of charged particles is a source of electrons; and the target material generates X-ray radiation upon impact by the electrons.

63. A method of generating radiation, comprising: directing a beam of charged particles towards a point target, the beam having a width;

differentially deflecting the beam across the width; and impacting the target by the deflected beam.

64. The method of claim 63, comprising:

differentially deflecting the beam by a magnetic field varying spatially across a width of the beam.

65. The method of claim 63, comprising:

differentially deflecting the beam across the width, thereby converging or diverging the beam.

66. A method of examining contents of an object with a radiation source, the method comprising:

directing a beam of charged particles towards a point target, the beam having a width;

differentially deflecting the beam across the width;

impacting the target by the deflected beam to generate radiation;

irradiating the object with the radiation; and detecting radiation interacting with the object.

67. A system for examining an object, the system, comprising:

a conveyor system to move the object through the system; and a radiation source comprising:

a housing;

a source of a beam of charged particles supported by the housing, to emit the beam along a first axis;

a point target supported by the housing, wherein impact of the beam with the target causes generation of radiation;

a magnet supported by the housing between the source and the target, the magnet comprising:

a core defining first and second opposing pole faces, wherein the core comprises material in which a magnetic field may be induced;

a coil around at least a portion of the core;

a current source coupled to the coil; and a controller coupled to the current source;

wherein:

the controller is programmed to:

selectively cause current flow in a first direction to generate a magnetic field to deflect the beam along a second axis angled with respect to the first axis, to intercept the target; and to selectively cause at least one of:

current flow in a second direction opposite the first direction, to generate a second magnetic field to deflect the beam along a third axis angled with respect to the first and second axes, to intercept the target, to generate a first diverging radiation beam; and no current flow, to allow the beam to travel undeflected along the first axis, to intercept the target, to generate a second diverging radiation beam;

the system further comprising:

a detector having a size greater than a size of the target, to detect diverging radiation beams interacting with the object.

68. The system of claim 67, wherein:

the controller is further programmed to:

repeatedly cycle among causing current flow in the first direction, and at least one of causing current flow in the second direction, and causing no current flow.

* * * * *